US011118818B2

(12) United States Patent
Hirayama et al.

(10) Patent No.: US 11,118,818 B2
(45) Date of Patent: Sep. 14, 2021

(54) PULSE TUBE CRYOCOOLER

(71) Applicant: SUMITOMO HEAVY INDUSTRIES, LTD., Tokyo (JP)

(72) Inventors: Takashi Hirayama, Nishitokyo (JP); Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 188 days.

(21) Appl. No.: 16/257,054

(22) Filed: Jan. 24, 2019

(65) Prior Publication Data

US 2019/0226725 A1 Jul. 25, 2019

(30) Foreign Application Priority Data

Jan. 25, 2018 (JP) ..... JP2018-010880

(51) Int. Cl.

| | |
|---|---|
| ***F25B 9/14*** | (2006.01) |
| ***F25B 9/06*** | (2006.01) |
| ***F25B 41/20*** | (2021.01) |
| *F25B 49/02* | (2006.01) |

(52) U.S. Cl.

CPC ..... *F25B 9/145* (2013.01); *F25B 9/06* (2013.01); *F25B 41/20* (2021.01); *F25B 49/02* (2013.01); *F25B 2309/1414* (2013.01); *F25B 2309/1415* (2013.01); *F25B 2309/1418* (2013.01)

(58) Field of Classification Search

CPC .... F25B 9/145; F25B 9/06; F25B 2309/1418; F25B 2309/1415; F25B 2309/1414; F25B 41/04; F25B 49/02; F25B 41/20

See application file for complete search history.

(56) References Cited

U.S. PATENT DOCUMENTS

| | | | | |
|---|---|---|---|---|
| 7,549,295 | B2 * | 6/2009 | Gao | F25B 9/10 137/625.46 |
| 8,516,833 | B2 * | 8/2013 | Xu | F25B 9/14 62/6 |
| 2003/0019218 | A1 * | 1/2003 | Hofmann | F25B 9/145 62/6 |

FOREIGN PATENT DOCUMENTS

| | | |
|---|---|---|
| JP | 2010-230308 A | 10/2010 |

* cited by examiner

*Primary Examiner* — Len Tran
*Assistant Examiner* — Carnot Joseph
(74) *Attorney, Agent, or Firm* — HEA Law PLLC

(57) ABSTRACT

A pulse tube cryocooler which includes a pulse tube having a pulse tube high-temperature end and a pulse tube low-temperature end, and extending in an axial direction from the pulse tube high-temperature end to the pulse tube low-temperature end. The pulse tube cryocooler further includes a regenerator having a regenerator high-temperature end and a regenerator low-temperature end, and being disposed rowed alongside the pulse tube, with the regenerator high-temperature end being positioned displaced, in terms of the axial direction, from the pulse tube high-temperature end toward the cryocooler low-temperature side, and the regenerator low-temperature end being fluid-passage linked with the pulse tube low-temperature end and a pressure-switching valve for connecting the regenerator high-temperature end to a high-pressure source and to a low-pressure source in alternation, and being disposed between the pulse tube high-temperature end and the regenerator high-temperature end in terms of the axial direction.

6 Claims, 6 Drawing Sheets

36

10

PULSE TUBE CRYOCOOLER

INCORPORATION BY REFERENCE

The content of Japanese Patent Application No. 2018-010880, on the basis of which priority benefits are claimed in an accompanying application data sheet, is in its entirety incorporated herein by reference.

BACKGROUND

Technical Field

The present invention in certain embodiments relates to a pulse tube cryocooler.

Description of Related Art

Pulse tube cryocoolers are grossly classified into two categories according to the arrangement of the pulse tube and the regenerator. One is a configuration in which common low-temperature ends of the pulse tube and the regenerator communicate by way of a relatively short rectilinear flow path, with the pulse tube and the regenerator respectively extending from the flow path to opposite ends of the cryocooler. Inasmuch as the pulse tube and the regenerator are connected in series this model is referred to as an "in-line type." The other is a configuration in which the common low-temperature ends of the pulse tube and the regenerator communicate by way of a flow path that is bent around, wherein the pulse tube and the regenerator extend from the flow path to the same end of the cryocooler. This model is sometimes referred to as a "U-type" or a "return-type." In general, the pulse tube and the regenerator are disposed rowed alongside each other, but can also be disposed coaxially.

SUMMARY

The present invention in a certain aspect affords a pulse tube cryocooler including: a compressor having a compressor discharge port and a compressor suction port; a pulse tube having a pulse tube high-temperature end and a pulse tube low-temperature end, and extending in an axial direction from the pulse tube high-temperature end to the pulse tube low-temperature end; a regenerator having a regenerator high-temperature end and a regenerator low-temperature end, and being disposed rowed alongside the pulse tube, with the regenerator high-temperature end being positioned displaced, in terms of the axial direction, from the pulse tube high-temperature end toward the cryocooler low-temperature side, and the regenerator low-temperature end being fluid-passage linked with the pulse tube low-temperature end; and a pressure-switching valve for connecting the regenerator high-temperature end to the compressor discharge port and the compressor suction port in alternation, to generate pressure oscillation inside the pulse tube, and being disposed between the pulse tube high-temperature end and the regenerator high-temperature end in terms of the axial direction.

In another aspect, the present invention affords a pulse-tube cryocooler cold head comprising the aforementioned pulse tube and regenerator, together with a pressure-switching valve for connecting the regenerator high-temperature end to a high-pressure source and to a low-pressure source in alternation, to generate pressure oscillation inside the pulse tube, and being disposed between the pulse tube high-temperature end and the regenerator high-temperature end in terms of the axial direction.

DETAILED DESCRIPTION

Figure 1:
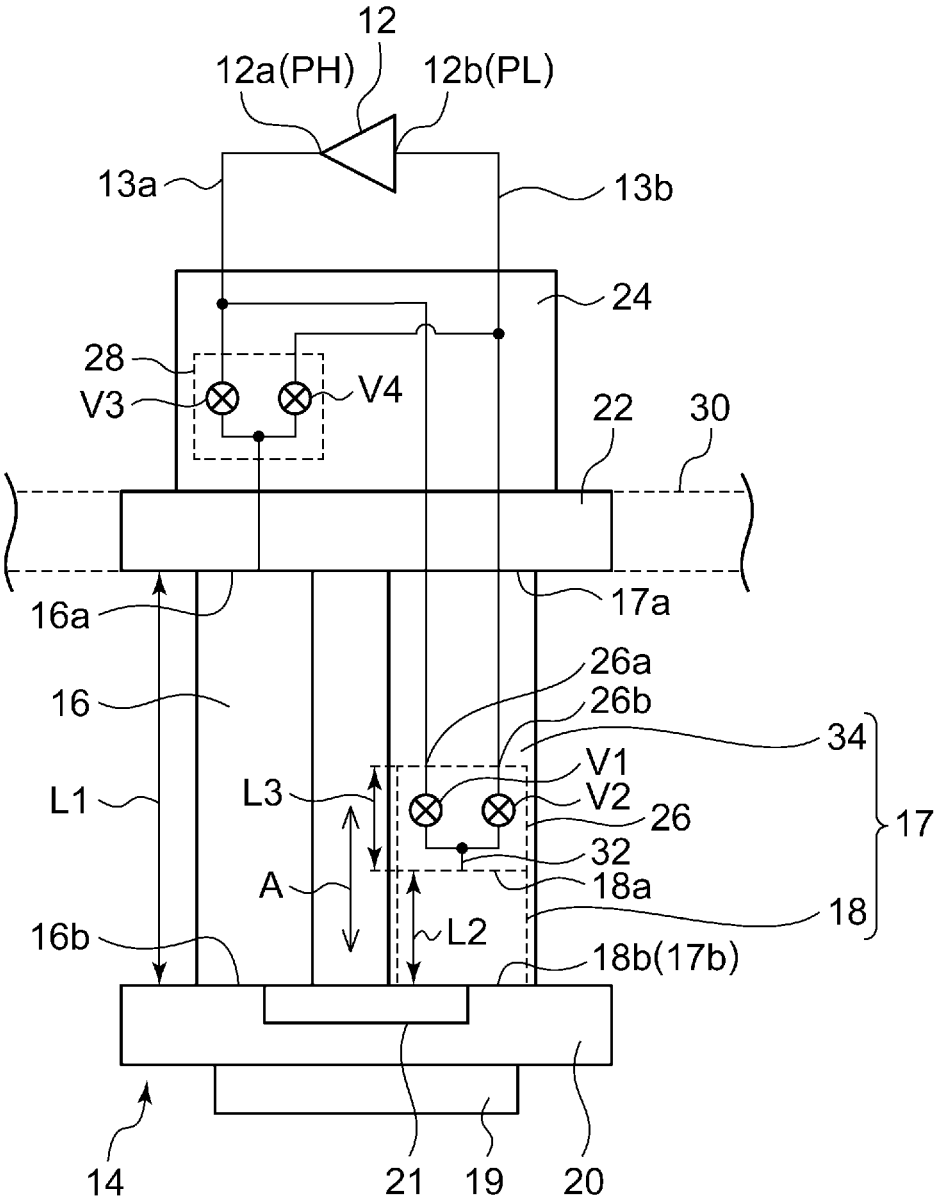
FIG. 1 is a schematic view illustrating a pulse tube cryocooler according to an embodiment.

In a typical parallel arrangement type pulse tube cryocooler, the respective low-temperature ends of the pulse tube and the regenerator are structurally connected to each other by using a low temperature side connection member which is also called a cooling stage. Respective high-temperature ends of the pulse tube and the regenerator are structurally connected to each other by using a high temperature side connection member such as a flange. The low temperature side connection member and the high temperature side connection member are disposed with a prescribed distance therebetween. The pulse tube and the regenerator extend in an axial direction between the connection members. Accordingly, the pulse tube and the regenerator have the same axial length.

In achieving refrigeration capacity required for the pulse tube cryocooler, it may not always be desirable to set the pulse tube and the regenerator to have the same axial length. Depending on a desirable design for improving performance, it is preferable that both of these differ from each other in some cases. In particular, according to the pulse tube cryocooler having large refrigeration capacity, the axial length of the regenerator may be considerably shorter than the axial length of the pulse tube.

The present inventor has recognized the following disadvantage. According to the parallel arrangement type pulse tube cryocooler in the related art, if there is a difference in the respective axial lengths of the pulse tube and the regenerator, the regenerator is thermally unstable during a cooling operation of the pulse tube cryocooler. This thermal disadvantage may result in poor efficiency of the regenerator, thereby causing poor efficiency of the cryocooler. In this regard, the thermal disadvantage is undesirable.

It is desirable to provide a technique for preventing poor efficiency of a pulse tube cryocooler.

Any desired combinations of the above-described configuration elements or those in which the configuration elements and expressions of the present invention are substituted with each other in methods, devices, or systems are also effective as an aspect according to the present invention.

According to the embodiment of the present invention, poor efficiency of a pulse tube cryocooler can be prevented.

Hereinafter, an embodiment according to the present invention will be described in detail with reference to the drawings. In the description, the same reference numerals will be given to the same elements, and repeated description thereof will be appropriately omitted. Configurations described below are merely examples, and do not limit the scope of the present invention at all. In the reference drawings for the following description, a size or a thickness of each configuration member is set for convenience of the description, and does not necessarily indicate an actual dimension or ratio.

FIG. 1 is a schematic view illustrating a pulse tube cryocooler 10 according to the embodiment. FIG. 1 schematically illustrates a working gas circuit of the pulse tube cryocooler 10.

The pulse tube cryocooler 10 includes a compressor 12 and a cold head 14. The cold head 14 includes a pulse tube 16, a regenerator tube 17, a regenerator 18, a cooling stage 20 for cooling a cooling target 19, a flange portion 22, and a room temperature portion 24. The pulse tube cryocooler 10 is a single stage type. However, the pulse tube cryocooler 10 can be a multiple stage type (for example, dual stage type).

As an example, the pulse tube cryocooler 10 is a four valve type Gifford-McMahon (GM) system. Accordingly, the cold head 14 further includes a pressure-switching valve 26 and a phase control valve 28. The pressure-switching valve 26 has a main suction opening/closing valve V1 and a main discharge opening/closing valve V2. The phase control valve 28 has a subsidiary suction opening/closing valve V3 and a subsidiary discharge opening/closing valve V4.

As will be described in detail later, in the pulse tube cryocooler 10, the pressure-switching valve 26 is disposed differently from a typical pulse tube cryocooler. The pressure-switching valve 26 is connected in series to the regenerator 18, and is disposed in parallel with the pulse tube 16 together with the regenerator 18. For example, the pressure-switching valve 26 is housed in the regenerator tube 17. In this way, the pressure-switching valve 26 is disposed next to the regenerator 18. On the other hand, similar to the typical pulse tube cryocooler, the phase control valve 28 is disposed in the room temperature portion 24. The pressure-switching valve 26 is not disposed in the room temperature portion 24, and is disposed in a place different from the phase control valve 28.

The compressor 12 and the pressure-switching valve 26 configure an oscillating flow generation source of the pulse tube cryocooler 10. That is, a steady flow of working gas produced by the compressor 12 is used so that a switching operation of the pressure-switching valve 26 can generate a pressure oscillation of the working gas inside the pulse tube 16 through the regenerator 18. In addition, the compressor 12 and the phase control valve 28 configure a phase control mechanism of the pulse tube cryocooler 10. The compressor 12 is shared by the oscillating flow generation source and the phase control mechanism. The switching operation of the phase control valve 28 can delay a phase of displacement oscillation of a gas element (also called a gas piston) inside the pulse tube 16, compared to the pressure oscillation of the working gas. Proper phase delay enables PV work to be carried out in a low-temperature end of the pulse tube 16, and can cool the working gas. The cooling stage 20 is cooled through heat exchange with the cooled working gas.

The compressor 12 has a compressor discharge port 12*a* and a compressor suction port 12*b*, and is configured to compress the recovered working gas having low pressure PL so as to generate working gas having high pressure PH. The working gas is supplied to the pulse tube 16 from the compressor discharge port 12*a* through the regenerator 18, and the working gas is recovered from the pulse tube 16 to the compressor suction port 12*b* through the regenerator 18. The compressor discharge port 12*a* and the compressor suction port 12*b* respectively function as a high-pressure source and a low-pressure source of the pulse tube cryocooler 10. The working gas is also called refrigerant gas, and is helium gas, for example.

The pulse tube cryocooler 10 is provided with a high-pressure line 13*a* and a low-pressure line 13*b*. Through the high-pressure line 13*a*, the working gas having the high pressure PH flows from the compressor 12 to the cold head 14. Through the low-pressure line 13*b*, the working gas having the low pressure PL flows from the cold head 14 to the compressor 12. The high-pressure line 13*a* connects the compressor discharge port 12*a* to the main suction opening/closing valve V1, and connects the compressor discharge port 12*a* to the subsidiary suction opening/closing valve V3. The low-pressure line 13*b* connects the compressor suction port 12*b* to the main discharge opening/closing valve V2, and connects the compressor suction port 12*b* to the subsidiary discharge opening/closing valve V4.

The pulse tube 16 has a pulse tube high-temperature end 16*a* and a pulse tube low-temperature end 16*b*, and extends from the pulse tube high-temperature end 16*a* to the pulse tube low-temperature end 16*b* in an axial line A. The pulse tube high-temperature end 16*a* and the pulse tube low-temperature end 16*b* may be respectively called a first end and a second end of the pulse tube 16.

Similarly, the regenerator tube 17 has a regenerator tube high-temperature end 17*a* and a regenerator tube low-temperature end 17*b*, and extends from the regenerator tube high-temperature end 17*a* to the regenerator tube low-temperature end 17*b* along the axial line A. The regenerator tube 17 is disposed in parallel with the pulse tube 16. The regenerator tube high-temperature end 17*a* and the regenerator tube low-temperature end 17*b* may be respectively called a first end and a second end of the regenerator tube 17. The regenerator 18 has a regenerator high-temperature end 18*a* and a regenerator low-temperature end 18*b*, and extends from the regenerator high-temperature end 18*a* to the regenerator low-temperature end 18*b* along the axial line A. The regenerator 18 is disposed in parallel with the pulse tube 16. The regenerator high-temperature end 18*a* and the regenerator low-temperature end 18*b* may be respectively called a first end and a second end of the regenerator 18.

The regenerator tube 17 accommodates the regenerator 18. The regenerator 18 is disposed on a low temperature side (that is, on the cooling stage 20 side, lower side in the drawing) of the regenerator tube 17, and the regenerator low-temperature end 18*b* is located at a position which is the same as that of the regenerator tube low-temperature end 17*b*. In terms of the axial line A, the pulse tube high-temperature end 16*a* and the regenerator tube high-temperature end 17*a* are located at the same position, and the pulse tube low-temperature end 16*b* and the regenerator tube low-temperature end 17*b* are located at the same position. On that account, the regenerator high-temperature end 18*a* is positioned displaced, in terms of the axial direction A, from the pulse tube high-temperature end 16*a* toward the cryocooler low-temperature side. The regenerator high-temperature end 18*a* is located separated from the regenerator tube high-temperature end 17*a* in terms of the axial line A.

Herein, the regenerator low-temperature end 18*b* and the regenerator tube low-temperature end 17*b* indicate the same location, but does not always indicate the same location. The regenerator low-temperature end 18*b* may be different from the regenerator tube low-temperature end 17*b*. In implementations where deemed necessary, the regenerator 18 may be disposed in the regenerator tube 17 more toward the cryocooler high-temperature side, while the regenerator low-temperature end 18*b* may be positioned displaced, in terms of the axial line A, from the regenerator tube low-temperature end 17*b* toward the cryocooler high-temperature side.

In an exemplary configuration, the pulse tube 16 is a cylindrical tube internally having a cavity. The regenerator tube 17 is a cylindrical member. The regenerator 18 is a region in which the regenerator tube 17 is internally filled with a regenerator material. The regenerator 18 is formed in a columnar shape.

The pulse tube 16 and the regenerator tube 17 are disposed adjacent to each other at an interval in a radial direction (direction perpendicular to the axial line A) of the pulse tube 16 so that respective central axes are parallel to each other. The pulse tube 16 and the regenerator tube 17 extend in the same direction from the cooling stage 20. The pulse tube high-temperature end 16*a* and the regenerator tube high-temperature end 17*a* are disposed on a side farther from the cooling stage 20. In this way, the pulse tube 16, the regenerator tube 17, and the cooling stage 20 are disposed in a U-shape.

The pulse tube low-temperature end 16*b* and the regenerator low-temperature end 18*b* are structurally connected and thermally coupled to each other by using a low temperature side connection member, for example, such as the cooling stage 20. The cooling stage 20 has a cooling stage flow path 21. Through the cooling stage flow path 21, the pulse tube low-temperature end 16*b* fluidly communicates with the regenerator low-temperature end 18*b*. Therefore, the working gas supplied from the compressor 12 can flow from the regenerator low-temperature end 18*b* to the pulse tube low-temperature end 16*b* through the cooling stage flow path 21. The gas returning from the pulse tube 16 can flow from the pulse tube low-temperature end 16*b* to the regenerator low-temperature end 18*b* through the cooling stage flow path 21.

The cooling target 19 is directly installed on the cooling stage 20, or is thermally coupled to the cooling stage 20 via a rigid or flexible heat transfer member. The pulse tube cryocooler 10 can cool the cooling target 19 by means of conduction cooling from the cooling stage 20. The cooling target 19 to be cooled by the pulse tube cryocooler 10 is not limited to solid matters such as superconducting electromagnets, other superconducting devices, infrared imaging elements, or other sensors. As a matter of course, the pulse tube cryocooler 10 can also cool gas or liquid which comes into contact with the cooling stage 20.

On the other hand, the pulse tube high-temperature end 16*a* and the regenerator tube high-temperature end 17*a* are connected to each other by using a high temperature side connection member, for example, such as the flange portion 22. The flange portion 22 is attached to a support portion 30 such as a support base or a support wall on which the pulse tube cryocooler 10 is installed. The support portion 30 may be a wall material or other locations of an insulation container or a vacuum container for accommodating the cooling stage 20 and the cooling target 19 (together with the regenerator tube 17 and the pulse tube 16).

The pulse tube 16 and the regenerator tube 17 extend from one main surface of the flange portion 22 to the cooling stage 20, and the room temperature portion 24 is disposed on the other main surface of the flange portion 22. Therefore, in a case where the support portion 30 configures a portion of the insulation container or the vacuum container, when the flange portion 22 is attached to the support portion 30, the pulse tube 16, the regenerator tube 17, the regenerator 18, and the cooling stage 20 are accommodated inside the container, and the room temperature portion 24 is disposed outside the container. Accordingly, whereas the pressure-switching valve 26 is accommodated inside the container, the phase control valve 28 is disposed outside the container.

The room temperature portion 24 does not need to be directly attached to the flange portion 22. The room temperature portion 24 may be disposed separately from the cold head 14 of the pulse tube cryocooler 10, and may be connected to the cold head 14 by means of rigid or flexible piping. In this way, the phase control mechanism of the pulse tube cryocooler 10 may be disposed separately from the cold head 14.

The pressure-switching valve 26 is disposed along the axial line A between the pulse tube high-temperature end 16*a* and the regenerator high-temperature end 18*a*. As described above, the pulse tube high-temperature end is located at the position which is the same as that of the regenerator tube high-temperature end 17*a* along the axial line A. Accordingly, the pressure-switching valve 26 is disposed along the axial line A between the regenerator tube high-temperature end 17*a* and the regenerator high-temperature end 18*a*. Description can also be made so that the pressure-switching valve 26 disposed between the flange portion 22 and the regenerator 18.

More specifically, the pressure-switching valve 26 is disposed adjacent to the regenerator high-temperature end 18*a*. For example, the pressure-switching valve 26 is disposed directly above the regenerator high-temperature end 18*a*. Therefore, a regenerator communication path 32 which enables the pressure-switching valve 26 to communicate with the regenerator 18 is considerably shorter along the axial line A, and the regenerator communication path 32 has a small volume. The regenerator communication path 32 causes the main suction opening/closing valve V1 and the main discharge opening/closing valve V2 to join the regenerator high-temperature end 18*a*.

The pressure-switching valve 26, together with the regenerator 18, is accommodated in the regenerator tube 17. The regenerator tube 17 includes a valve accommodation portion 34 which accommodates the pressure-switching valve 26. The valve accommodation portion 34 is a container which accommodates the pressure-switching valve 26, and extends from the regenerator 18 to the flange portion 22 along the axial line A. Accordingly, the regenerator tube high-temperature end 17*a* belongs to the valve accommodation portion 34, and the regenerator tube low-temperature end 17*b* belongs to the regenerator 18.

Axial lengths L1 of the pulse tube 16 and the regenerator tube 17 are substantially the same as each other. The axial length L1 corresponds to a distance between the flange portion 22 and the cooling stage 20. On the other hand, an axial length L2 of the regenerator 18 is shorter than the axial length L1 of the pulse tube 16, and is shorter than half of the axial length L1, for example. A difference in the axial lengths of the pulse tube 16 and the regenerator 18 is often observed in a large size pulse tube cryocooler (that is, the pulse tube cryocooler which can provide large refrigeration capacity). According to the large size pulse tube cryocooler, in order to improve performance, the axial length L2 of the regenerator 18 can be designed so as to be considerably shorter than the axial length L1 of the pulse tube 16.

Therefore, the regenerator tube 17 also serves as a spacer or length adjustment member to adjust the axial length of the regenerator 18. Since the axial length of the regenerator tube 17 is adjusted, the difference in the axial lengths of the pulse tube 16 and the regenerator 18 can be minimized or eliminated.

The pressure-switching valve 26 has a dimension which can be accommodated in the valve accommodation portion 34. Accordingly, an axial length L3 of the pressure-switching valve 26 is smaller than a difference (L1–L2) between the axial length L1 of the pulse tube 16 (or the regenerator tube 17) and the axial length L2 of regenerator 18. The axial length L3 of the pressure-switching valve 26 may be the same as the difference (L1–L2).

The pressure-switching valve 26 includes a high-pressure port 26*a* serving as an inlet of the working gas having the high pressure PH, which is supplied to the pressure-switching valve 26, and a low-pressure port 26*b* serving as an outlet of the working gas having the low pressure PL, which is supplied from the pressure-switching valve 26. The high-pressure line 13*a* extends from the compressor discharge port 12*a* to the high-pressure port 26*a*. The main suction opening/closing valve V1 connects the high-pressure port 26*a* to the regenerator high-temperature end 18*a*. The low-pressure line 13*b* extends from the compressor suction port 12*b* to the low-pressure port 26*b*. The main discharge opening/closing valve V2 connects the low-pressure port 26*b* to the regenerator high-temperature end 18*a*.

The pressure-switching valve 26 is disposed in the regenerator tube 17, specifically, in the valve accommodation portion 34. Accordingly, the high-pressure port 26*a* and the low-pressure port 26*b* are also disposed in the valve accommodation portion 34. Therefore, the high-pressure line 13*a* and the low-pressure line 13*b* extend to the low temperature side beyond the pulse tube high-temperature end 16*a* along the axial line A. The high-pressure line 13*a* and the low-pressure line 13*b* respectively extend from the room temperature portion 24 to the high-pressure port 26*a* and the low-pressure port 26*b* beyond the flange portion 22 and the regenerator tube high-temperature end 17*a*. In this way, the pressure-switching valve 26 is incorporated in the regenerator tube 17 together with a portion of the high-pressure line 13*a* and the low-pressure line 13*b*.

The pressure-switching valve 26 is configured to alternately connect the regenerator high-temperature end 18*a* to the compressor discharge port 12*a* and the compressor suction port 12*b* in order to generate the pressure oscillation inside the pulse tube 16. The pressure-switching valve 26 is configured to respectively and exclusively open the main suction opening/closing valve V1 and the main discharge opening/closing valve V2. That is, the main suction opening/closing valve V1 and the main discharge opening/closing valve V2 are inhibited from being open at the same time. When the main suction opening/closing valve V1 is open, the main discharge opening/closing valve V2 is closed. When the main discharge opening/closing valve V2 is open, the main suction opening/closing valve V1 is closed. The main suction opening/closing valve V1 and the main discharge opening/closing valve V2 may be temporarily closed together.

When the main suction opening/closing valve V1 is open, the working gas is supplied to the regenerator 18 from the compressor discharge port 12*a* through the high-pressure line 13*a*, the main suction opening/closing valve V1, and the regenerator communication path 32. The working gas is further supplied to the pulse tube 16 through the cooling stage flow path 21. On the other hand, when the main discharge opening/closing valve V2 is open, the working gas is recovered from the pulse tube 16 to the compressor suction port 12*b* through the cooling stage flow path 21, the regenerator 18, the regenerator communication path 32, the main discharge opening/closing valve V2, and the low-pressure line 13*b*.

The phase control valve 28 is configured to alternately connect the pulse tube high-temperature end 16*a* to the compressor discharge port 12*a* and the compressor suction port 12*b*. The subsidiary suction opening/closing valve V3 connects the compressor discharge port 12*a* to the pulse tube high-temperature end 16*a*, and the subsidiary discharge opening/closing valve V4 connects the compressor suction port 12*b* to the pulse tube high-temperature end 16*a*.

The phase control valve 28 is configured to respectively and exclusively open the subsidiary suction opening/closing valve V3 and the subsidiary discharge opening/closing valve V4. That is, the subsidiary suction opening/closing valve V3 and the subsidiary discharge opening/closing valve V4 are inhibited from being open at the same time. When the subsidiary suction opening/closing valve V3 is open, the subsidiary discharge opening/closing valve V4 is closed. When the subsidiary discharge opening/closing valve V4 is open, the subsidiary suction opening/closing valve V3 is closed. The subsidiary suction opening/closing valve V3 and the subsidiary discharge opening/closing valve V4 may be temporarily closed together.

When the subsidiary suction opening/closing valve V3 is open, the working gas is supplied to the pulse tube 16 from the compressor discharge port 12*a* through the high-pressure line 13*a*, the subsidiary suction opening/closing valve V3, and the pulse tube high-temperature end 16*a*. On the other hand, when the subsidiary discharge opening/closing valve V4 is open, the working gas is recovered from the pulse tube 16 to the compressor suction port 12*b* through the pulse tube high-temperature end 16*a*, the subsidiary discharge opening/closing valve V4, and the low-pressure line 13*b*.

As valve timings for these valves (V1 to V4), it is possible to adopt various valve timings applicable to the existing four valve type pulse tube cryocooler.

There are various specific configurations of the valves (V1 to V4). For example, a group of the valves (V1 to V4) can take a form in which a plurality of valves can be individually controlled. The respective valves (V1 to V4) may be electromagnetic opening/close valves. A group of the valves (V1 to V4) may be configured to automatically perform an opening/closing operation at a pre-determined valve timing.

As will be described later, the pressure-switching valve 26, that is, the main suction opening/closing valve V1 and the main discharge opening/closing valve V2 may be configured to serve as a rotary valve. The phase control valve 28, that is, the subsidiary suction opening/closing valve V3 and the subsidiary discharge opening/closing valve V4 may be configured to serve as a rotary valve which is separate from the pressure-switching valve 26.

According to a certain embodiment, a group of the valves (V1 to V4) may be a combination of the rotary valve and an individually controllable valve. For example, any one of the pressure-switching valve 26 and the phase control valve 28 may be configured to serve as the rotary valve, and the other one may be configured to serve as the individually controllable valve.

According to this configuration, the pulse tube cryocooler 10 generates the pressure oscillation of the working gas having the high pressure PH and the low pressure PL inside the pulse tube 16. In synchronization with the pressure oscillation, a phase is properly delayed, thereby generating displacement oscillation of the working gas inside the pulse tube 16. That is, a gas piston is caused to reciprocate. The movement of the working gas which vertically and periodically reciprocates inside the pulse tube 16 while certain pressure is maintained is called the "gas piston," and is often used to describe the operation of the pulse tube cryocooler 10. When the gas piston is located in or near the pulse tube high-temperature end 16*a*, the working gas expands in the pulse tube low-temperature end 16*b*, thereby generating cold. This refrigeration cycle is repeated, thereby enabling the pulse tube cryocooler 10 to cool the cooling stage 20. Therefore, the pulse tube cryocooler 10 can cool the cooling target 19.

Figure 2:
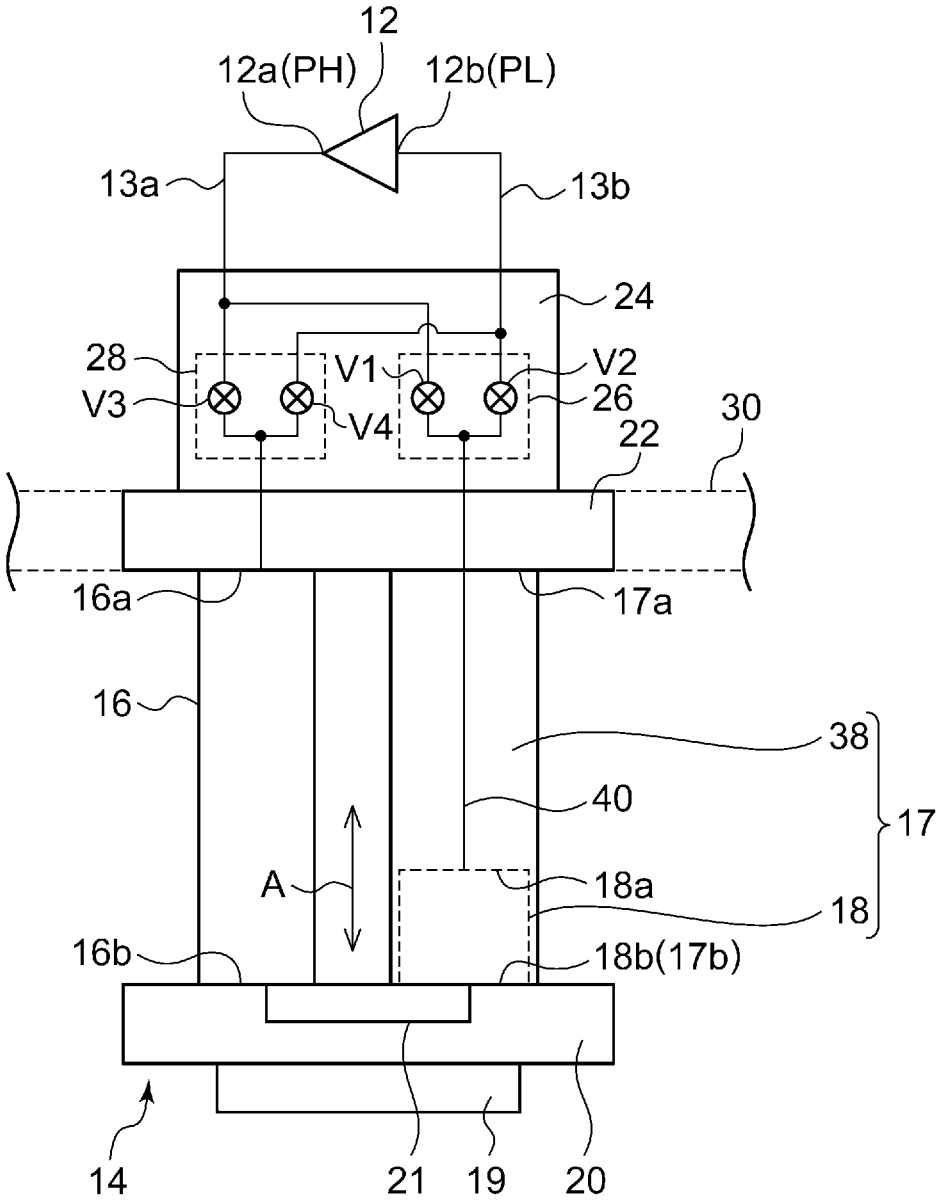
FIG. 2 is a schematic view illustrating a pulse tube cryocooler according to a comparative example.

FIG. 2 is a schematic view illustrating a pulse tube cryocooler 36 according to a comparative example. In FIG. 2, the typical pulse tube cryocooler 36 is illustrated for comparison. Accordingly, an advantageous effect achieved by the pulse tube cryocooler 10 according to the embodiment can be more satisfactorily understood. A main difference between the comparative example and the embodiment is that the pressure-switching valve 26 is differently disposed.

In the pulse tube cryocooler 36 according to the comparative example, the pressure-switching valve 26 is disposed in the room temperature portion 24 together with the phase control valve 28. Therefore, the pressure-switching valve 26 is disposed considerably apart from the regenerator 18 along the axial line A.

The regenerator tube 17 includes the regenerator 18 and a spacer 38. The regenerator 18 is located on the low temperature side of the regenerator tube 17, and has an axial length which is shorter than that of the pulse tube 16. A surplus empty space is formed on the high temperature side of the regenerator tube 17. The spacer 38 is inserted in order to fill the empty space. The spacer 38 connects the regenerator 18 to the flange portion 22. A spacer penetrating flow path 40 is disposed in order to enable the pressure-switching valve 26 to fluidly communicate with the regenerator high-temperature end 18*a*. Through the spacer penetrating flow path 40, the working gas can flow to and flow out from the regenerator 18.

If the axial lengths are remarkably different between the pulse tube 16 and the regenerator 18 in this way, a thermal disadvantage appears in the regenerator 18 during a cooling operation of the pulse tube cryocooler 36. When the high pressure working gas is supplied to the spacer penetrating flow path 40 in a suction stroke of the pulse tube cryocooler 36, the working gas is subjected to adiabatic compression inside the flow path, thereby generating compression heat. Helium gas generally used as the working gas generates considerable compression heat due to a physical property. The compression heat raises the temperature of the working gas flowing into the pulse tube 16. As the axial length of the regenerator 18 is shorter than that of the pulse tube 16, the spacer penetrating flow path 40 becomes longer, and a volume thereof increases. Accordingly, the generated compression heat increases. Therefore, the temperature of the gas flowing into the regenerator which is raised by the compression heat may become noticeable in the large size pulse tube cryocooler. Accordingly, the efficiency of the regenerator becomes poor, and the efficiency of the pulse tube cryocooler 36 also becomes poor.

On the other hand, according to the pulse tube cryocooler 10 in the embodiment, the pressure-switching valve 26 is disposed along the axial line A between the pulse tube high-temperature end 16*a* and the regenerator high-temperature end 18*a*. In this manner, the pressure-switching valve 26 can be disposed close to the regenerator 18. Therefore, it is possible to minimize the volume of the regenerator communication path 32, that is, the volume in which the adiabatic compression occurs in the suction stroke of the pulse tube cryocooler 10. Rise in temperature of the gas flowing into the regenerator 18 is prevented, and the poor efficiency of the regenerator is also prevented. Therefore, the poor efficiency of the pulse tube cryocooler can be prevented.

The pressure-switching valve 26 is disposed adjacent to the regenerator high-temperature end 18*a*. According to this configuration, the volume of the regenerator communication path 32 can be particularly minimized.

The pressure-switching valve 26 is accommodated in the regenerator tube 17 together with the regenerator 18. According to this configuration, the surplus space inside the regenerator tube 17 disposed on the high temperature side of the regenerator 18 can be utilized as the container of the pressure-switching valve 26.

The high-pressure line 13*a* and the low-pressure line 13*b* extend to the low temperature side along the axial line A beyond the pulse tube high-temperature end 16*a*. This configuration is also helpful in minimizing the volume of the regenerator communication path 32 by disposing the pressure-switching valve 26 to be close to the regenerator high-temperature end 18*a*.

Figure 3:
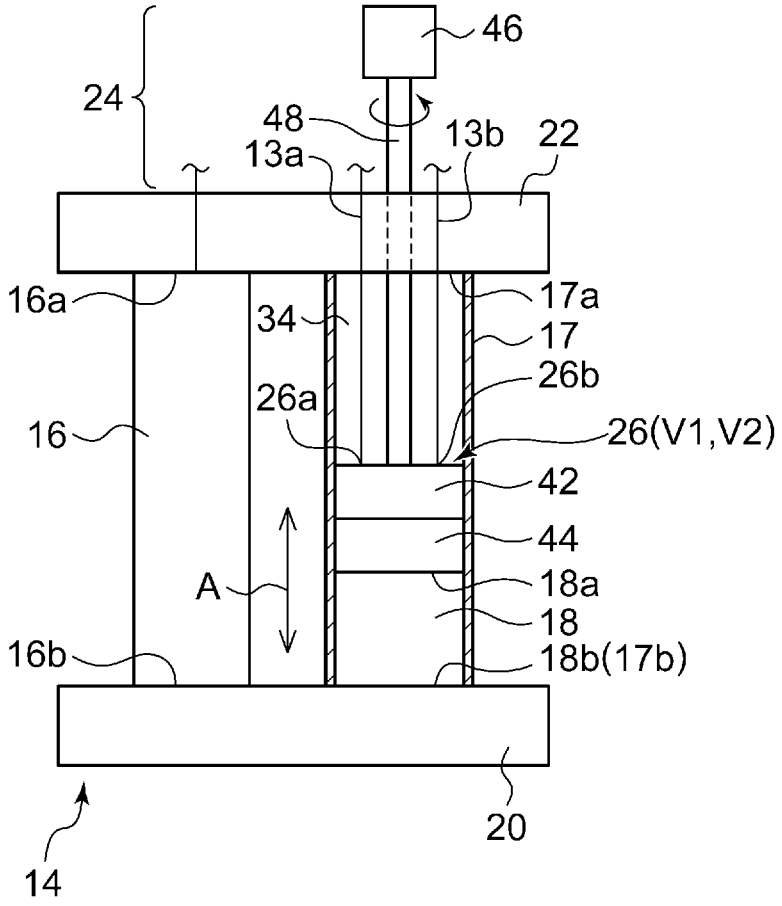
FIG. 3 is a schematic view illustrating an example of a pressure-switching valve applicable to the pulse tube cryocooler according to the embodiment.

FIG. 3 is a schematic view illustrating an example of the pressure-switching valve 26 applicable to the pulse tube cryocooler 10 according to the embodiment. FIG. 3 schematically illustrates the pulse tube 16, the regenerator tube 17, the cooling stage 20, and a main portion of the cold head 14 including the flange portion 22. Similar to the pulse tube cryocooler 10 illustrated in FIG. 1, the pulse tube 16, the regenerator tube 17, and the cooling stage 20 are disposed in a U-shape. The pulse tube low-temperature end 16*b* and the regenerator tube low-temperature end 17*b* are connected to each other in the cooling stage 20. The pulse tube high-temperature end 16*a* and the regenerator tube high-temperature end 17*a* are connected to each other in the flange portion 22.

The pressure-switching valve 26 is configured to serve as the rotary valve, and includes a valve rotor 42 and a valve stator 44. The pressure-switching valve 26 is configured that the opening/closing of the main suction opening/closing valve V1 and the main discharge opening/closing valve V2 are periodically switched therebetween by the valve rotor 42 rotationally sliding relative to the valve stator 44.

The pressure-switching valve 26 further includes a motor 46 and a drive shaft 48 as a drive mechanism of rotary valves (42 and 44). The motor 46 is disposed in the room temperature portion 24. The rotary valves (42 and 44) are disposed along the axial line A between the pulse tube high-temperature end 16*a* (that is, the regenerator tube high-temperature end 17*a*) and the regenerator high-temperature end 18*a*, and are driven via the drive shaft 48 by driving the motor 46. One end of the drive shaft 48 is connected to the motor 46, and the other end is connected to the valve rotor 42. The drive shaft 48 is rotated by a rotational output of the motor 46, and the rotation of the drive shaft 48 is transmitted to the valve rotor 42.

The rotary valves (42 and 44) are disposed in the valve accommodation portion 34 of the regenerator tube 17. The rotary valves (42 and 44) are disposed adjacent to the regenerator high-temperature end 18*a* so that the valve stator 44 is in contact with the regenerator high-temperature end 18*a*. The drive shaft 48 extends to the low temperature side along the axial line A beyond the pulse tube high-temperature end 16*a*. In this way, the drive shaft 48 is connected to the valve rotor 42. Together with the drive shaft 48, the high-pressure line 13*a* and the low-pressure line 13*b* also extend to the low temperature side along the axial line A beyond the pulse tube high-temperature end 16*a* (that is, the regenerator tube high-temperature end 17*a*). The drive shaft 48, the high-pressure line 13*a*, and the low-pressure line 13*b* extend to the valve accommodation portion 34 from the room temperature portion 24 after penetrating the flange portion 22. The high-pressure line 13*a* is connected to the high-pressure port 26*a*, and the low-pressure line 13*b* is connected to the low-pressure port 26*b*. The high-pressure port 26*a* and the low-pressure port 26*b* are disposed in the valve rotor 42.

In a case where the pressure-switching valve 26 is used as the rotary valves (42 and 44) in this way, the rotary valves (42 and 44) can be disposed close to the regenerator high-temperature end 18*a*. Accordingly, it is possible to minimize the volume of the flow path between the rotary valves (42 and 44) and the regenerator high-temperature end 18*a*, that is, the volume in which the adiabatic compression occurs in the suction stroke of the pulse tube cryocooler 10. Rise in temperature of the gas flowing into the regenerator 18 is prevented, and the poor efficiency of the regenerator is also prevented. Therefore, the poor efficiency of the pulse tube cryocooler can be prevented.

FIGS. 4A to 5B are schematic views illustrating another example of the pressure-switching valve 26 applicable to the pulse tube cryocooler 10 according to the embodiment. Referring to these drawings, an internal flow path of the rotary valves (42 and 44) will be described as an example. The internal flow path of the rotary valves (42 and 44) can be designed in various ways by adopting the known flow path configuration. This example does not limit the invention at all.

Figure 4A:
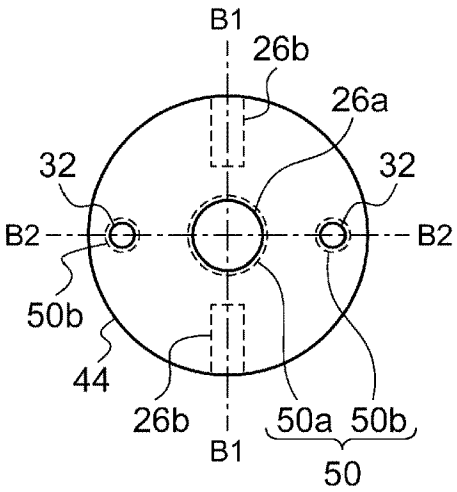
FIGS. 4A to 4C are schematic views illustrating another example of the pressure-switching valve applicable to the pulse tube cryocooler according to the embodiment.
Figure 4B:
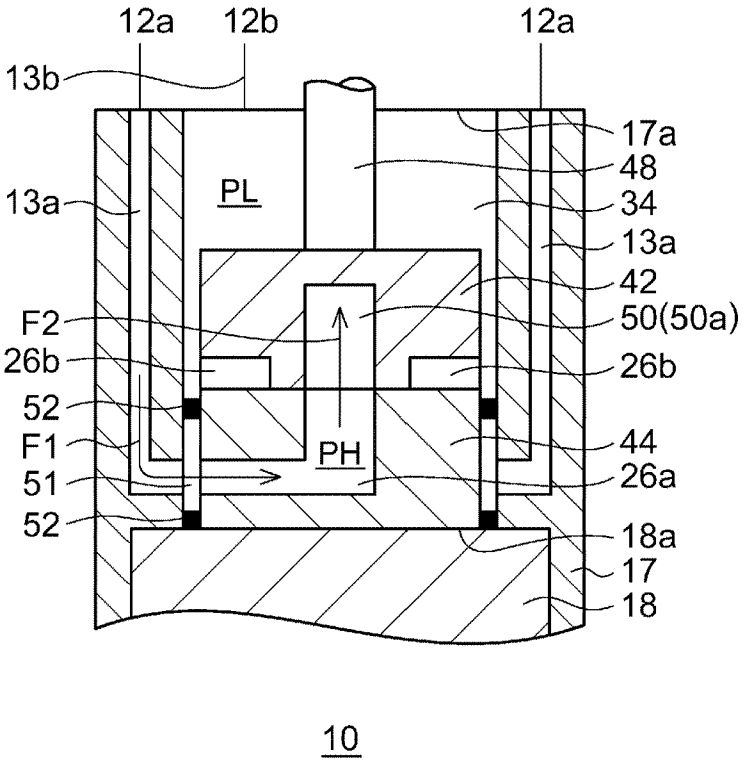
Figure 4C:
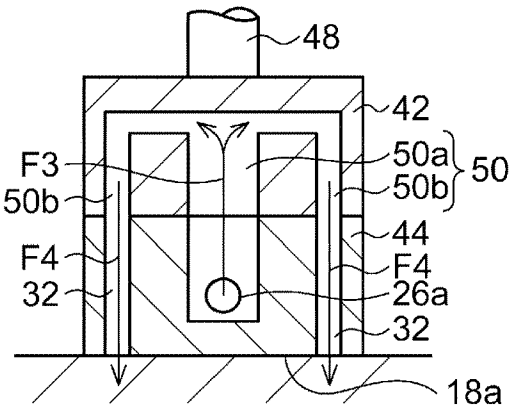

FIG. 4A illustrates rotary sliding surface of the rotary valves (42 and 44). In FIG. 4A, an upper surface of the valve stator 44 is indicated by a solid line, and a lower surface of the valve rotor 42 is indicated by a broken line. FIGS. 4B and 4C respectively illustrate a cross section B1 and a cross section B2 in FIG. 4A. The cross sections B1 and B2 are cross sections of the rotary valves (42 and 44) which are obtained by two planes perpendicular to each other through a central axis (rotation axis) of the rotary valves (42 and 44). The regenerator tube 17 is also illustrated in FIG. 4B.

The upper surface of the valve stator 44 is in surface contact with the lower surface of the valve rotor 42. As the valve rotor 42 is rotated, the lower surface of the valve rotor 42 rotationally slides on the upper surface of the valve stator 44. The valve stator 44 is fixed to the regenerator tube 17 so as not to be rotated. The drive shaft 48 is connected to the upper surface of the valve rotor 42 so that the rotation of the drive shaft 48 is transmitted to the valve rotor 42.

The valve stator 44 has the high-pressure port 26*a* and the regenerator communication path 32. The high-pressure port 26*a* penetrates the upper surface from a side surface of the valve stator 44. The high-pressure port 26*a* is open at the center on the upper surface of the valve stator 44. The regenerator communication path 32 includes two flow paths penetrating the lower surface from the upper surface of the valve stator 44 in the axial direction. The two flow paths are located on sides opposite to each other across the high-pressure port 26*a* on the upper surface of the valve stator 44. The lower surface of the valve stator 44 is in contact with the regenerator high-temperature end 18*a*. The regenerator communication path 32 fluidly communicates with the regenerator 18.

The valve rotor 42 has the low-pressure port 26*b* and the high pressure communication path 50. The low-pressure port 26*b* includes two recessed portions formed on the lower surface of the valve rotor 42. The two recessed portions are located on sides opposite to each other across the center on the lower surface of the valve rotor 42. The low-pressure port 26*b* communicates with a peripheral space of the valve rotor 42, that is, the valve accommodation portion 34. The high pressure communication path 50 has a high pressure inlet 50*a* which is open at the center on the lower surface of the valve rotor 42 and two high pressure outlets 50*b* located on sides opposite to each other across the center on the lower surface of the valve rotor 42. The high pressure communication path 50 is divided into two inside the valve rotor 42 from the high pressure inlet 50*a* to the high pressure outlets 50*b*. A first diameter in which the high pressure outlet 50*b* and the high pressure inlet 50*a* are aligned with each other on the lower surface of the valve rotor 42 is perpendicular to a second diameter in which the low-pressure port 26*b* and the high pressure inlet 50*a* are aligned with each other. The cross sections B1 and B2 are cross sections respectively obtained by the first diameter and the second diameter.

Both the high-pressure port 26*a* and the high pressure inlet 50*a* are located on the central axis. Accordingly, both of these communicate with each other. The regenerator communication path 32, the low-pressure port 26*b*, and the high pressure outlet 50*b* are located at the same radial position on the rotary sliding surface of the rotary valves (42 and 44). Therefore, as the valve rotor 42 is rotated, the regenerator communication path 32 is alternately connected to the high pressure outlet 50*b* and the low-pressure port 26*b*.

The high-pressure line 13*a* is formed inside a side wall portion surrounding the rotary valves (42 and 44) in the valve accommodation portion 34 of the regenerator tube 17. In the high-pressure line 13*a*, the side wall portion extends from the regenerator tube high-temperature end 17*a* to the high-pressure port 26*a* in the axial direction. The low-pressure line 13*b* is connected to the regenerator tube high-temperature end 17*a*. The working gas having the low pressure PL is introduced into the peripheral space of the valve rotor 42, that is, the valve accommodation portion 34. It can be described that the valve accommodation portion 34 is a portion of the low-pressure line 13*b*. In order to prevent the working gas having the high pressure PH which flows from a connection region 51 connected from the high-pressure line 13*a* to the high-pressure port 26*a* from leaking to a low pressure region (valve accommodation portion 34) and the regenerator 18, a sealing portion 52 is disposed on the side surface of the valve stator 44. The connection region 51 is a clearance or a gap between the side surface of the valve stator 44 and the side wall portion of the regenerator tube 17.

FIGS. 4A to 4C illustrate a flow path connection of the pressure-switching valve 26 in the suction stroke of the pulse tube cryocooler 10. Accordingly, the high pressure outlet 50*b* communicates with the regenerator communication path 32. In this case, the working gas having the high pressure PH flows into the rotary valves (42 and 44) from the high-pressure line 13*a* to the high-pressure port 26*a* (arrow F1 in FIG. 4B). The working gas flows from the high-pressure port 26*a* through the high pressure inlet 50*a* and the high pressure outlet 50*b* of the high pressure communication path 50 (arrow F2 in FIG. 4B and arrow F3 in FIG. 4C) to the regenerator communication path 32 (arrow F4 in FIG. 4C). In this way, the working gas having the high pressure PH can flow from the high-pressure line 13*a* to the regenerator high-temperature end 18*a*.

Figure 5A:
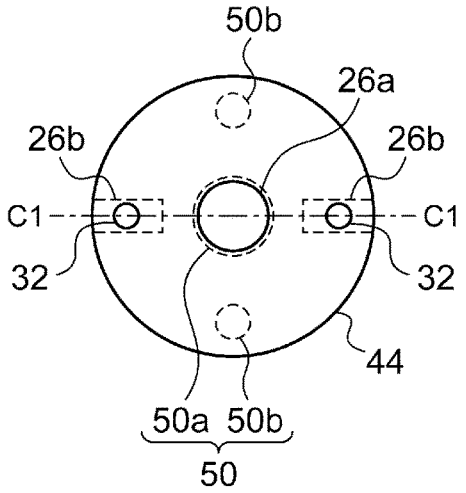
FIGS. 5A and 5B are schematic views illustrating another example of the pressure-switching valve applicable to the pulse tube cryocooler according to the embodiment.
Figure 5B:
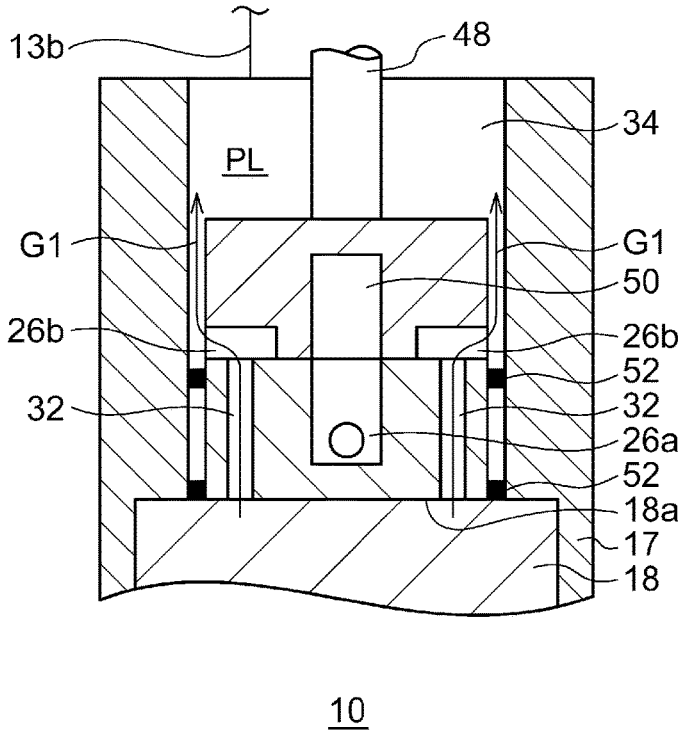

FIGS. 5A and 5B illustrate a flow path connection of the pressure-switching valve 26 in the discharge stroke of the pulse tube cryocooler 10. FIG. 5A illustrates a rotary sliding surface of the rotary valves (42 and 44), and FIG. 5B illustrates a cross section C1 in FIG. 5A. The cross section C1 is a cross section passing through the central axis (rotation axis) of the rotary valves (42 and 44) and the above-described second diameter (diameter in which the low-pressure port 26*b* and the high pressure inlet 50*a* are aligned with each other).

Compared to the suction stroke illustrated in FIGS. 4A to 4C, in FIGS. 5A and 5B, the valve rotor 42 is rotated 90 degrees, and the low-pressure port 26*b* communicates with the regenerator communication path 32. Accordingly, the working gas flows from the regenerator high-temperature end 18*a* to the low-pressure port 26*b* through the regenerator communication path 32 (arrow G1 in FIG. 5B). In this way, the working gas having the low pressure PL can flow from the regenerator high-temperature end 18*a* to the low-pressure line 13*b*.

Therefore, the rotary valves (42 and 44) can alternately connect the regenerator high-temperature end 18*a* to the compressor discharge port 12*a* and the compressor suction port 12*b* in order to generate the pressure oscillation inside the pulse tube 16.

Figure 6:
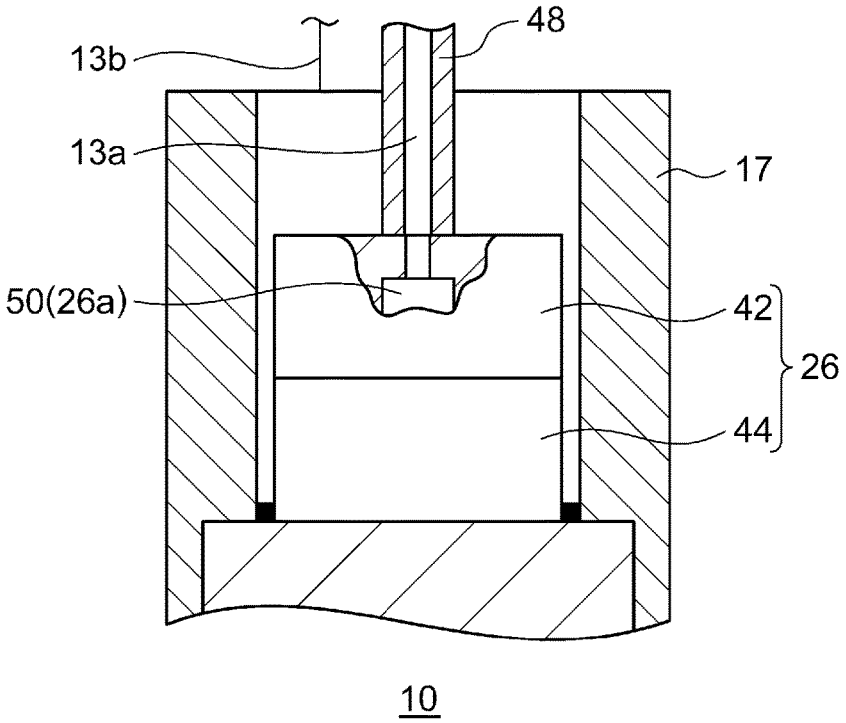
FIG. 6 is a schematic view illustrating another example of the pressure-switching valve applicable to the pulse tube cryocooler according to the embodiment.

FIG. 6 is a schematic view illustrating another example of the pressure-switching valve 26 applicable to the pulse tube cryocooler 10 according to the embodiment. It is not essential that the high-pressure line 13*a* is formed in the side wall portion of the regenerator tube 17 as described above. As illustrated in FIG. 6, the high-pressure line 13*a* may be formed inside the drive shaft 48. In this case, the high pressure communication path 50 of the valve rotor 42 serves as the high-pressure port 26*a*. Accordingly, the high-pressure port 26*a* is not required for the valve stator 44.

Other configurations can also be adopted. For example, the high-pressure line 13*a* may be connected to the regenerator tube high-temperature end 17*a* so as to introduce the working gas having the high pressure PH to the valve accommodation portion 34. The low-pressure line 13*b* may be formed in the side wall portion of the regenerator tube 17 or inside the drive shaft 48.

Figure 7A:
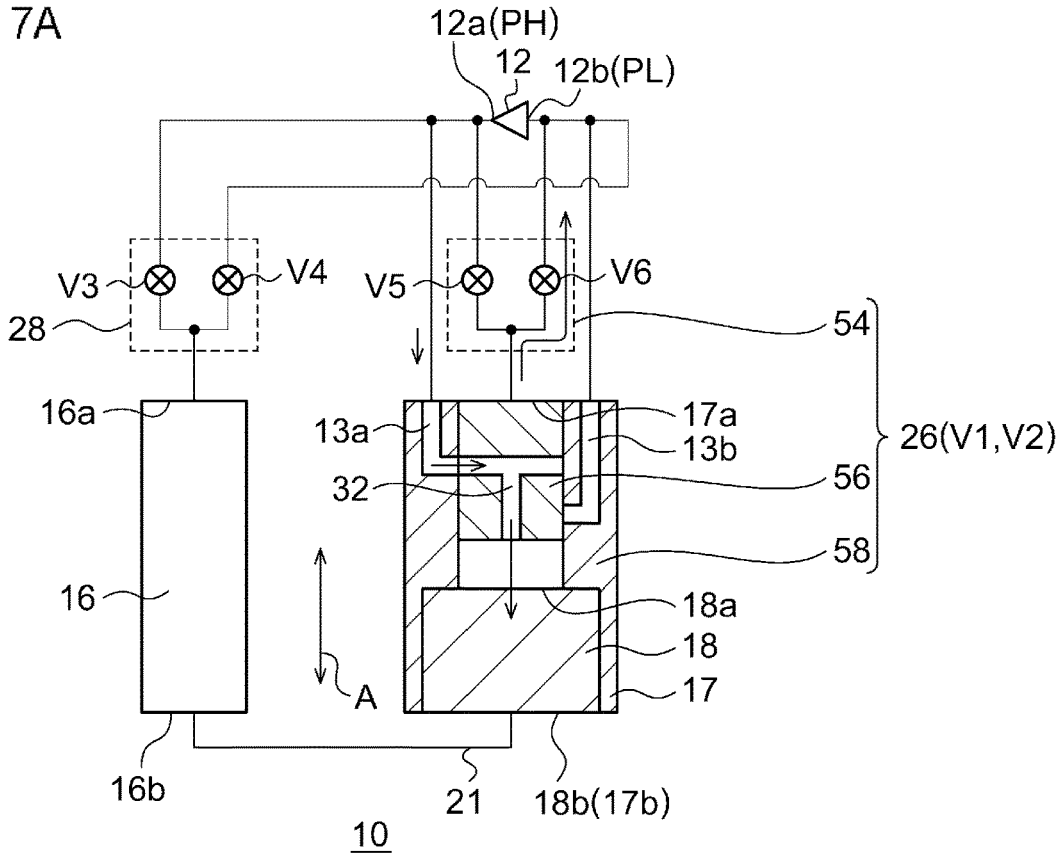
FIGS. 7A and 7B are schematic views illustrating another example of the pressure-switching valve applicable to the pulse tube cryocooler according to the embodiment.
Figure 7B:
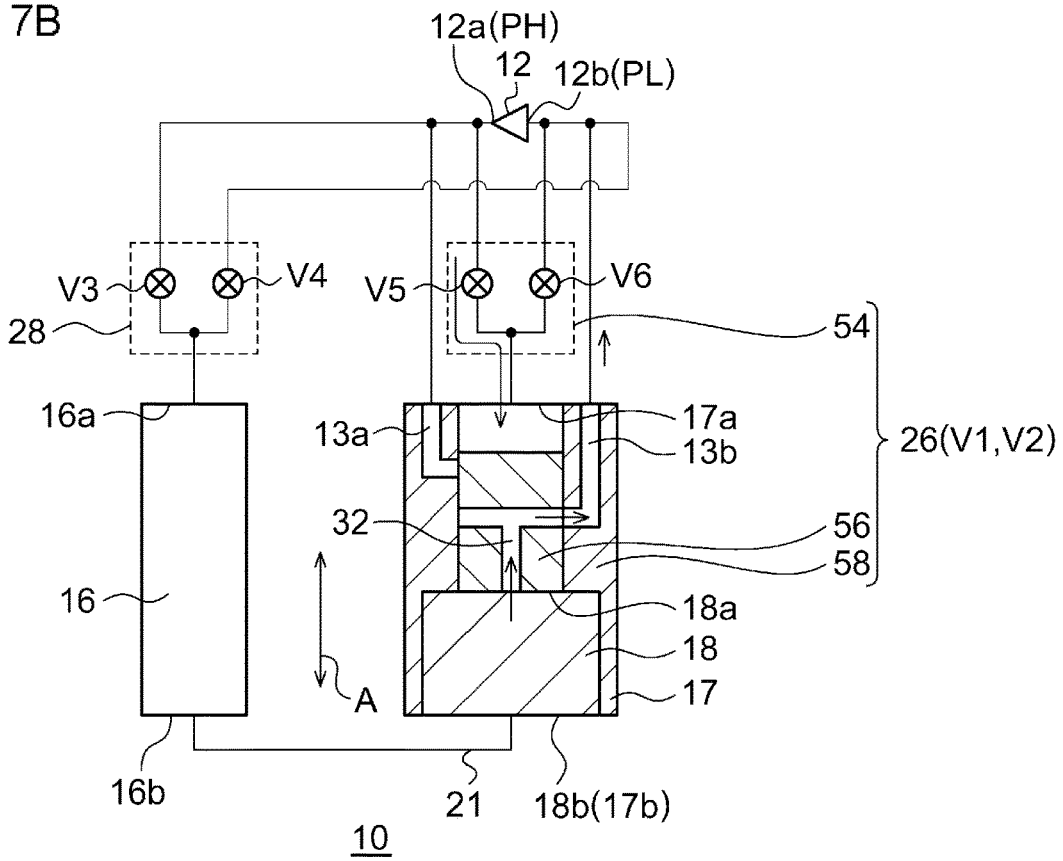

FIGS. 7A and 7B are schematic views illustrating another example of the pressure-switching valve 26 applicable to the pulse tube cryocooler 10 according to the embodiment. FIGS. 7A and 7B respectively illustrate a flow path connection of the pressure-switching valve 26 in the suction stroke and the discharge stroke of the pulse tube cryocooler 10.

The pressure-switching valve 26 includes a control valve 54 for controlling the control pressure, a valve piston 56, and a valve cylinder 58. The valve piston 56 is configured to reciprocate so as to alternately connect the regenerator high-temperature end 18*a* to the compressor discharge port 12*a* and the compressor suction port 12*b* under the agency of the pressure differential between the gas pressure acting on the regenerator 18, and the control pressure. The valve cylinder 58 is configured to guide the valve piston 56 to reciprocate. The side wall portion of the regenerator tube 17 surrounding the pressure-switching valve 26 is used as the valve cylinder 58. The valve piston 56 and the valve cylinder 58 are disposed along the axial line A between the pulse tube high-temperature end 16*a* (that is, the regenerator tube high-temperature end 17*a*) and the regenerator high-temperature end 18*a*.

The valve piston 56 and the valve cylinder 58 configure the main suction opening/closing valve V1 and the main discharge opening/closing valve V2. The phase control valve 28 has the subsidiary suction opening/closing valve V3 and the subsidiary discharge opening/closing valve V4, and is configured to alternately connect the pulse tube high-temperature end 16*a* to the compressor discharge port 12*a* and the compressor suction port 12*b*.

The control valve 54 is configured to control the control pressure acting on one side of the valve piston 56 by utilizing the compressor 12. The control valve 54 includes a first opening/closing valve V5 for connecting the compressor discharge port 12*a* to the regenerator tube high-temperature end 17*a* and a second opening/closing valve V6 for connecting the compressor suction port 12*b* to the regenerator tube high-temperature end 17*a*.

The valve piston 56 is disposed adjacent to the regenerator high-temperature end 18*a*. The valve piston 56 together with the regenerator 18 is accommodated in the regenerator tube 17. Therefore, the gas pressure which is the same as that of the regenerator 18 acts on a side opposite to the valve piston 56 (side opposite to the side on which the control pressure acts). The valve piston 56 can move along the valve cylinder 58 under the agency of the pressure differential between the control pressure, and the gas pressure of the regenerator 18.

The high-pressure line 13*a* and the low-pressure line 13*b* are formed in the valve cylinder 58. The valve piston 56 has the regenerator communication path 32. The pulse tube low-temperature end 16*b* and the regenerator low-temperature end 18*b* (the regenerator tube low-temperature end 17*b*) communicate with each other by using the cooling stage flow path 21.

As illustrated in FIG. 7A, when the valve piston 56 is located at a first position, the high-pressure line 13*a* communicates with the regenerator communication path 32. In order to move the valve piston 56 to the first position, the second opening/closing valve V6 is open. At this time, the first opening/closing valve V5 is closed. The control pressure reaches the low pressure PL, and the pressure becomes lower than the pressure of the regenerator 18. Accordingly, the valve piston 56 moves from the regenerator high-temperature end 18*a* to the regenerator tube high-temperature end 17*a*. On the other hand, as illustrated in FIG. 7B, if the valve piston 56 is located at a second position, the low-pressure line 13*b* communicates with the regenerator communication path 32. In order to move the valve piston 56 to the second position, the second opening/closing valve V6 is closed, and the first opening/closing valve V5 is open. The control pressure reaches the high pressure PH, and the pressure is higher than the pressure of the regenerator 18. Accordingly, the valve piston 56 moves from the regenerator tube high-temperature end 17*a* to the regenerator high-temperature end 18*a*.

Therefore, the pressure-switching valve 26 can alternately connect the regenerator high-temperature end 18*a* to the compressor discharge port 12*a* and the compressor suction port 12*b* in order to generate the pressure oscillation inside the pulse tube 16.

It should be understood that the invention is not limited to the above-described embodiment, but may be modified into various forms on the basis of the spirit of the invention. Additionally, the modifications are included in the scope of the invention.

In the above-described embodiment, the pulse tube 16, the regenerator tube 17, and the cooling stage 20 are disposed in the U-shape. However, the embodiment is not limited thereto. Instead of the U-shaped arrangement, the pulse tube 16 and the regenerator tube 17 may be coaxially disposed. For example, the regenerator tube 17 and the regenerator 18 may be disposed on the axis, and the pulse tube 16 may be coaxially disposed so as to surround the regenerator tube 17 and the regenerator 18. Even in this case, the pressure-switching valve 26 may be disposed along the axial line A between the pulse tube high-temperature end 16*a* and the regenerator high-temperature end 18*a*. The pressure-switching valve 26 may be disposed adjacent to the regenerator high-temperature end 18*a*, and may be accommodated in the regenerator tube 17 together with the regenerator 18.

In the present invention, it is not essential that the pulse tube cryocooler 10 is the four valve type pulse tube cryocooler. The pulse tube cryocooler 10 may have a phase control mechanism having a different configuration. For example, a double inlet type pulse tube cryocooler, or an active buffer type pulse tube cryocooler may be employed.

The pulse tube cryocooler 10 is not limited to the single stage type. The pulse tube cryocooler 10 may be a multiple stage type (for example, a dual stage type) pulse tube cryocooler. In a multiple stage type pulse tube cryocooler, the pressure-switching valve 26 may be disposed along the axial line A between a first stage pulse tube high-temperature end and a first stage regenerator high-temperature end.

What is claimed is:

1. A pulse tube cryocooler comprising:

a compressor having a compressor discharge port and a compressor suction port;

a pulse tube having a pulse tube high-temperature end and a pulse tube low-temperature end, and extending in an axial direction from the pulse tube high-temperature end to the pulse tube low-temperature end;

a regenerator having a regenerator high-temperature end and a regenerator low-temperature end, and being disposed rowed alongside the pulse tube, with the regenerator high-temperature end being positioned, in terms of the axial direction, from the pulse tube high-temperature end toward a cooling stage side, and the regenerator low-temperature end being fluid-passage linked with the pulse tube low-temperature end;

a pressure-switching valve for connecting the regenerator high-temperature end to the compressor discharge port and the compressor suction port in alternation, to generate pressure oscillation inside the pulse tube, and being disposed between the pulse tube high-temperature end and the regenerator high-temperature end in terms of the axial direction, and a regenerator tube disposed rowed alongside the pulse tube, and housing the regenerator, wherein the pressure-switching valve is also housed in the regenerator tube.

2. The pulse tube cryocooler according to claim 1, wherein the pressure-switching valve is disposed adjacent to the regenerator high-temperature end.

3. The pulse tube cryocooler according to claim 1, further comprising:

a high-pressure line that extends from the compressor discharge port to a high-pressure port of the pressure-switching valve; and a low-pressure line that extends from the compressor suction port to a low-pressure port of the pressure-switching valve; wherein the high-pressure line and the low-pressure line extend toward the cryocooler low-temperature side beyond, in terms of the axial direction, the pulse tube high-temperature end.

4. The pulse tube cryocooler according to claim 1, wherein:

the pressure-switching valve includes a control valve for controlling a control pressure, a valve piston for reciprocating under the agency of a pressure differential between gas pressure acting on the regenerator, and the control pressure, to connect the regenerator high-temperature end to the compressor discharge port and the compressor suction port in alternation, and a valve cylinder for guiding reciprocation of the valve piston; and the valve piston and the valve cylinder are disposed between, in terms of the axial direction, the pulse tube high-temperature end and the regenerator high-temperature end.

5. A pulse tube cryocooler comprising:

a compressor having a compressor discharge port and a compressor suction port;

a pulse tube having a pulse tube high-temperature end and a pulse tube low-temperature end, and extending in an axial direction from the pulse tube high-temperature end to the pulse tube low-temperature end;

a regenerator having a regenerator high-temperature end and a regenerator low-temperature end, and being disposed rowed alongside the pulse lube, with the regenerator high-temperature end being positioned, in terms of the axial direction, from the pulse tube high-temperature end toward a cooling stage side, and the regenerator low-temperature end being fluid-passage linked with the pulse tube low-temperature end; and a pressure-switching valve for connecting the regenerator high-temperature end to the compressor discharge port and the compressor suction port in alternation, to generate pressure oscillation inside the pulse tube, and being disposed between the pulse tube high-temperature end and the regenerator high-temperature end in terms of the axial direction, wherein:

the pressure-switching valve includes a motor, a drive shaft, and a rotary valve disposed between, in terms of the axial direction, the pulse tube high-temperature end and the regenerator high-temperature end, and being driven via the drive shaft by driving the motor; and the drive shaft extends toward the cooling stage side beyond, in terms of the axial direction, the pulse tube high-temperature end.

6. A pulse-tube cryocooler cold head comprising:

a pulse tube having a pulse tube high-temperature end and a pulse tube low-temperature end, and extending in an axial direction from the pulse tube high-temperature end to the pulse tube low-temperature end;

a regenerator having a regenerator high-temperature end and a regenerator low-temperature end, and being disposed rowed alongside the pulse tube, with the regenerator high-temperature end being positioned, in terms of the axial direction, from the pulse tube high-temperature end toward a cooling stage side, and the regenerator low-temperature end being fluid-passage linked with the pulse tube low-temperature end;

a pressure-switching valve for connecting the regenerator high-temperature end to a high-pressure source and to a low-pressure source in alternation, to generate pressure oscillation inside the pulse tube, and being disposed between the pulse tube high-temperature end and the regenerator high-temperature end in terms of the axial direction; and a regenerator tube disposed rowed alongside the pulse tube, and housing the regenerator, wherein the pressure-switching valve is also housed in the regenerator tube.

* * * * *